US011197798B2

(12) United States Patent
Shohat et al.

(10) Patent No.: US 11,197,798 B2
(45) **Date of Patent: *Dec. 14, 2021**

(54) GASTROINTESTINAL CAPSULE

(71) Applicant: VIBRANT LTD., Yokneam (IL)

(72) Inventors: Shaul Shohat, Kfar Haoranim (IL); Alexander Belenky, Hod Hasharon (IL); Roni Shabat, Kibbutz Izrael (IL)

(73) Assignee: Vibrant Ltd., Yokneam (IL)

( * ) Notice: Subject to any disclaimer, the term of this patent is extended or adjusted under 35 U.S.C. 154(b) by 916 days.

This patent is subject to a terminal disclaimer.

(21) Appl. No.: 15/359,731

(22) Filed: Nov. 23, 2016

(65) Prior Publication Data

US 2017/0135897 A1 May 18, 2017

Related U.S. Application Data

(63) Continuation of application No. 14/732,733, filed on Jun. 7, 2015, now Pat. No. 9,532,923, which is a (Continued)

(51) Int. Cl.
*A61H 23/02* (2006.01)

(52) U.S. Cl.
CPC ..... *A61H 23/0263* (2013.01); *A61H 23/02* (2013.01); *A61H 2205/083* (2013.01)

(58) Field of Classification Search
CPC ..... A61H 23/0263; A61H 23/02; A61H 2205/083; A61H 23/00; A61H 23/0254; A61H 1/00
See application file for complete search history.

(56) References Cited

U.S. PATENT DOCUMENTS 3,485,235 A * 12/1969 Felson ..... A61M 37/00 600/582
4,507,115 A 3/1985 Kambara et al.
(Continued)

FOREIGN PATENT DOCUMENTS

WO WO2007013059 A3 2/2007

OTHER PUBLICATIONS

International Search Report for PCT/IL2007/001139 dated Jul. 23, 2008.

(Continued)

*Primary Examiner* — Quang D Thanh
(74) *Attorney, Agent, or Firm* — Momentum IP; Marc Van Dyke

(57) ABSTRACT

An ingestible gastrointestinal capsule (GIC) for mechanically stimulating a segment of the gastrointestinal (GI) wall by alternately and repeatedly pressurizing, and/or vibrating it is provided. The GIC is programmed to being activated following a predefined time delay. The activated GIC agitates, shakes, rattles, jolts, vibrates and/or moves in a reciprocal expanding and contracting motion thereby mechanically stimulating the adjacent segment of the GI wall at a targeted location. Activation of the GIC may include a number of automatically accomplished partial activations, such as when the time elapsed from the moment of setting the GIC on equals a predefined time delay; when the mechanical load applied onto the GIC exceeds, and/or gets lower than a respective predefined level of mechanical load; when the ambient pH reaches a predefined level, or changes, and/or a temperature associated with the user reaches a predefined threshold. Agitation is accomplished by an agitation mechanism embedded in the GIC. Such agitation mechanism includes an unbalanced weight attached to the shaft of an electric motor, an actuator implemented by, (Continued)

such as an electric solenoid, an electro-active polymer (EAP), a dielectric elastomer actuator (DEA), embedded in a GIC of the invention.

10 Claims, 1 Drawing Sheet

Related U.S. Application Data continuation of application No. 12/310,201, filed as application No. PCT/IL2007/001139 on Sep. 17, 2007, now Pat. No. 9,078,799.

(60) Provisional application No. 60/845,200, filed on Sep. 18, 2006.

(56) References Cited

U.S. PATENT DOCUMENTS

| | | | | |
|---|---|---|---|---|
| 6,453,199 | B1 * | 9/2002 | Kobozev | A61N 1/36007 340/573.1 |
| 6,984,205 | B2 | 1/2006 | Gazdzinski | |
| 9,078,799 | B2 * | 7/2015 | Shohat | A61H 23/02 |
| 9,532,923 | B2 * | 1/2017 | Shohat | A61H 23/02 |
| 9,707,150 | B2 * | 7/2017 | Shabbat | A61B 1/00156 |
| 10,543,348 | B2 * | 1/2020 | Ben-Tsur | A61B 5/6873 |
| 2002/0132226 | A1 | 9/2002 | Nair et al. | |
| 2004/0050394 | A1 | 3/2004 | Jin | |
| 2005/0085696 | A1 * | 4/2005 | Uchiyama | A61B 1/00147 600/160 |
| 2005/0177069 | A1 | 8/2005 | Takizawa et al. | |
| 2006/0094992 | A1 * | 5/2006 | Imboden | A61H 19/00 601/70 |
| 2006/0169293 | A1 * | 8/2006 | Yokoi | A61B 1/00156 128/899 |
| 2006/0211963 | A1 * | 9/2006 | Spirk | A61H 23/0254 601/93 |
| 2007/0123809 | A1 * | 5/2007 | Weiss | A61H 21/00 601/84 |
| 2007/0238940 | A1 | 10/2007 | Amirana | |
| 2009/0281380 | A1 | 11/2009 | Miller et al. | |

OTHER PUBLICATIONS

Written Opinion for PCT/IL2007/001139 dated Jul. 23, 2008.

Dicyclomine Oral: Uses, Side Effects, Interactions, Pictures, Warnings & Dosing—Uses—WebMD, retrieved Jul. 25, 2021 https://www.webmd.com/drugs/2/drug-5247/dicyclomine-oral/details.

Dicyclomine Oral: Uses, Side Effects, Interactions, Pictures, Warnings & Dosing—Side Effects—WebMD, retrieved Jul. 25, 2021 https://www.webmd.com/drugs/2/drug-5247/dicyclomine-oral/details.

Hyoscyamine Oral: Uses, Side Effects, Interactions, Pictures, Warnings & Dosing—Uses—WebMD—retrieved Jul. 25, 2021 https://www.webmd.com/drugs/2/drug-13766/hyoscyamine-oral/details.

Hyoscyamine Oral: Uses, Side Effects, Interactions, Pictures, Warnings & Dosing—Side Effects—WebMD—retrieved Jul. 25, 2021 https://www.webmd.com/drugs/2/drug-13766/hyoscyamine-oral/details.

* cited by examiner

GASTROINTESTINAL CAPSULE

CROSS REFERENCE TO RELATED APPLICATIONS

The patent application is a continuation of U.S. Ser. No. 14/732,733 filed on Jun. 7, 2015 (incorporated by reference), which is also a continuation of U.S. Ser. No. 12/310,201 filed on Feb. 17, 2009 (incorporated by reference), which is a National Stage application filed under 35 U.S.C. § 371 of PCT/IL07/01139 filed on Sep. 17, 2007 (incorporated by reference), which claims priority to U.S. Provisional patent application 60/845,200 filed on Sep. 18, 2006 is hereby incorporated in its entirety by reference.

FIELD OF THE INVENTION

The present invention relates in general to medical devices, particularly to ingestible capsules introducible to the gastrointestinal tract.

BACKGROUND OF THE INVENTION

Medical devices such as ingestible capsules providing for diagnosis of the gastrointestinal tract are common in the marketplace. In World Patent Application WO07013059A2, which is incorporated herein by reference, an extendable capsule introducible into an organ, such as the stomach or intestine, for treatment purposes, such as in cases of morbid obesity, is disclosed. One or more arms attached to the main body of the capsule can be extended to touch inner surfaces of the organ at respective contact points. The arms can be repeatedly moved, such as in a sliding motion, a tilting motion and/or a perpendicular pressure motion, thereby stimulating and or moving the inner surfaces of the organ at the respective points of contact is accomplished.

Constipation represents a significant problem. More than 130 million people suffer from this problem worldwide. The present medication is partially effective and is associated with significant side effects. Vibration applied to the abdominal wall, such as by its massaging, generally stimulate the gastrointestinal tract and thereby alleviate constipation. However, such technique is cumbersome and may be ineffective in patients with a thick or muscular abdominal wall which may attenuate such vibrations. Therefore any device providing for alternately and repeatedly pressurizing and vibrating the intestine walls and thereby stimulating them is beneficial.

DETAILED DESCRIPTION OF THE PRESENT INVENTION

Figure 1:
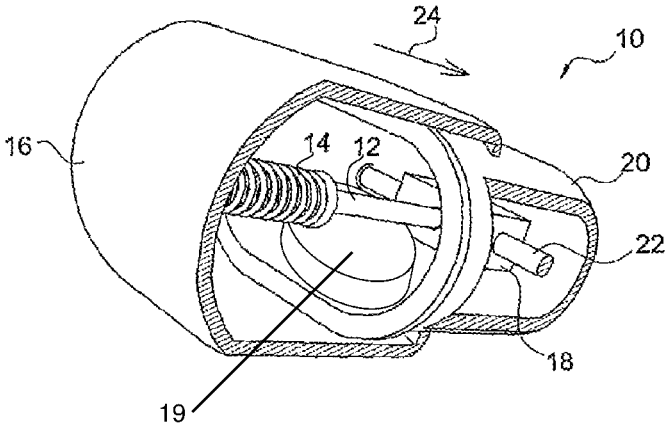
FIG. 1 is a fragmented isometric view of a gastrointestinal capsule according to a preferred embodiment of the present invention.

In accordance with the present invention a gastrointestinal capsule (GIC) for alternately and repeatedly vigorously pressurizing, and/or vibrating the gastrointestinal (GI) walls is provided. A GIC of the present invention is set to being activated prior to its being ingested by the user. The ingested GIC is automatically activated a predefined time following its being set up and swallowed. The activated GIC vigorously agitates, shakes, rattles, jolts, vibrates and/or moves in a reciprocal expanding and contracting motion thereby mechanically stimulating the adjacent segment of the GI wall. Mechanical vibrations, cyclic variations in the pressure and/or mechanical shocks are excited in the chyme contained within a segment of the GI tract and/or directly applied to the walls of the GI tract, by the agitating GIC. Agitation is accomplished by means of agitation means embedded in the GIC. Such agitation means includes any of the following: an unbalanced weight attached to the shaft of an electric motor, or an actuator implemented by, such as an electric solenoid, an electro-active polymer (EAP), a dielectric elastomer actuator (DEA), embedded in a GIC of the invention. Such means are preferable to piezoelectric materials as they are capable of vigorously moving the GIC along significant distances thereby exerting significant pressure changes, such that the mechanical disturbance progresses along a significant distance prior to its being absorbed and decayed.

Stimulating the motor activity of a GI tract comprises in accordance with the method of the present invention the steps of (a) ingesting a GIC that passes along the GI tract, and (b) activating the GIC when it reaches a predefined segment of the GI tract to agitate, shake, rattle, jolt, bump, and/or vibrate. The transit time of chyme along the intestinal tract is known and/or optionally be individually measured. The time interval by which activation is delayed from the moment of ingestion according to a preferred embodiment of the present invention is such set that the GIC is activated as it reaches the targeted segment of the GI tract. The activated GIC mechanically excites the wall of the GI tract, to induce a peristaltic wave whereby the motor activity of this segment is stimulated.

The mechanical excitation is effected by the movement of the capsule that impinges and presses on the walls of this segment. The activation of the capsule is automatically accomplished after a predefined time interval elapses from the moment of its being set prior to its ingesting. Activation according to the present invention may include a number of partial activations. Optionally a partial activation can be externally induced, such as by sensing a predefined level of the ambient pH, or an increase in the pH level following its evacuation from the stomach, sensing a predefined level of a temperature associated with the user, sensing a predefined level of the mechanical load applied onto the GIC, or by a remote activation such as by transmitting radio frequency (RF), ultra-sound (US), or an infrared activation signals, as known. At the end of the process the GIC is naturally evacuated with the stool.

In accordance with some embodiments of the present invention activation of a GIC is set to automatically occur 2 to 6 hours following ingestion. A time delay of six hours typically fits in with a transit time in which the GIC reaches the large bowel. The transit time within the large bowel is significantly longer in the range of 2 to 5 days depending whether the transit time is normal or prolonged as in cases of constipation. Therefore in such cases the time delay for activation ranges between 6 t 24 hours. Generally GICs of the invention are capable to agitate along time intervals in the range of 15 minutes to 6 hours, preferably, between 15 minutes to 2 hours. In accordance with another embodiment of the present invention a GIC provides for stimulating the motor activity of the small bowel, thereby reducing absorption of food especially fats along the small bowel, such as for treating obesity. In this case the activation of a GIC is set to occur 15 minutes up to 4 hours following ingestion and preferably between half an hour to 2 hours from ingestion. Selected agitation times ranges between 15 minutes to 6 hours and preferably between 30 minutes to 4 hours. The time profiles of the agitation of a GIC are programmable according to the present invention. An activation mechanism implemented by an electric circuitry embedded in the GIC provides for synchronizing the activation of a GIC in accordance with a preferred embodiment of the present invention as well as for time profiling its agitation. For example the GIC intermittently vibrates within predefined time intervals in the range of a few dozens of seconds up to a few dozens of minutes. These time intervals are interleaved with pauses which last for predefined time interval within the same ranges.

The agitated vibrations are at a frequency or frequencies within a predefined frequency band which ranges from a few tenths of Hz up to a few kHz. Preferable are frequencies up to dozens of Hz.

Figure 2:
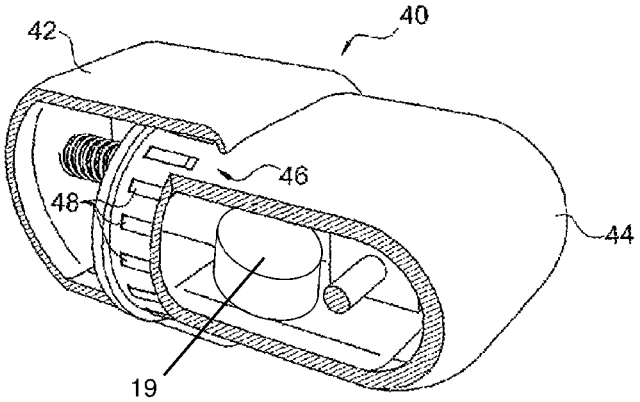
FIG. 2 is a fragmented isometric view of a gastrointestinal capsule according to another preferred embodiment of the present invention at a contracted position.
Figure 3:
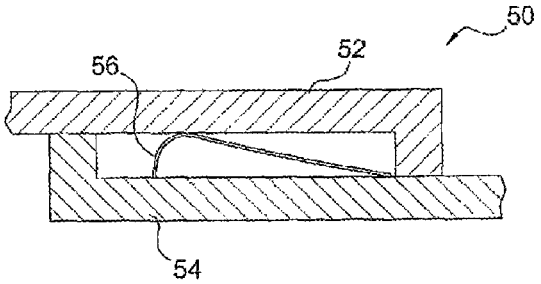
FIG. 3 is a sectional view of a segment of the gastrointestinal capsule shown in FIG. 2.

Reference is now made to FIGS. 1-3. In FIG. 1 a fragmented isometric view of a GIC in accordance with a preferred embodiment of the present invention is shown. GIC 10 has a shell consisting of two segments of shell slidingly attached to each other. One end of ferromagnetic shaft 12 is connected by means of biasing spring 14 to the inner surface of segment 16. The second end of ferromagnetic shaft 12 is free to axially move along the lumen of solenoid 18, which is connected to the inner surface of segment 20 by means of bracket 22. Optionally the second end of ferromagnetic shaft 12 is connected by means of a connecting spring, not shown, to the inner surface of segment 20. By conducting electrical current through solenoid 18, ferromagnetic shaft 12 and solenoid 18 are mutually pulled to move towards each other. Such pull stretches biasing spring 12 thereby segment 16 is pulled to move in the direction indicated by arrow 24 concomitantly with a respective motion of segment 20 in the opposite direction. In the case that the second end of the ferromagnetic shaft is connected to segment 20, the connecting spring is respectively compressed by such motion. By stopping the electrical current, biasing spring 12 concomitantly with the connecting spring assume their initial unstressed lengths whilst segment 16 and segment 20 are forced to move in opposite directions towards the positions in which they were initially disposed. A typical length of GIC 10 when is fully contracted is in the range of 10-15 millimeters (mm), whereas when fully extended its length reaches up to 20 mm. Namely a GIC of the invention while is agitated at least one of its dimension significantly changes. GIC 10 typically weighs a few up to 25 grams. Therefore when a GIC is agitated the level of forces it exerts unto the chyme or the GI walls are significant compared to the level of peristaltic forces and/or the resulting pressure levels normally exerted by GI wall unto the chyme.

By suitably selecting the values of the electrical current, the inductance of the solenoid, the elastic constants of the springs and the masses of the springs, segments of the shell, solenoid and the ferromagnetic shaft, the levels and the time profiles of the forces applied onto the segments of the shell as well as the maximal speeds in which both shell's segments move are controlled. By intermittently and repeatedly conducting electrical current, such as by applying direct voltage on both terminals of solenoid 18 by electrically connecting them to an electric battery 19 housed in the GIC, mechanical vibrations, cyclic variations of the pressure and/or mechanical shocks are excited in the chyme contained in a GI tract. Such vibrations, pressure variations and/or mechanical shocks propagate through the chyme to a significant extent and agitate the adjacent GI walls. Obviously such vibrations and/or mechanical shocks are directly applied onto the walls of the GI tract at points of contact and/or whilst the GIC is disposed at a close proximity to the walls.

A GIC in accordance with another preferred embodiment of the present invention is especially suitable to treat constipation. The agitation means of the GIC includes an electric motor having an unbalanced weight attached to its shaft. The motor is operative in two different modes following its activation. In the first mode which is the sensing mode of the GIC the activated motor intermittently rotates at a relatively low revolution rate along a predefined time intervals interleaved with pauses which last along a second predefined time interval. The intermittently rotating motor applies pulses of vibrations and mechanical shocks onto the GIC for the first predefined time interval and then pauses for the second predefined time interval. Such motion is repeatedly agitated for a predefined number of cycles, or along a predefined moderate agitation time. The mechanical load applied onto the motor is concomitantly measured along this cyclic motion, such as by measuring the motor current and/or by measuring the temperature profile of the motor. A servo mechanism incorporated with the activation mechanism is automatically activated to switch the motor into its second mode of operation when the load applied onto the motor exceeds a predefined threshold. Otherwise the same cycle is repeated all over again and again following a pause which lasts for a third predefined time interval. At places along the GI tract in which the activated GIC is suspended within a relatively dilute, or watery chyme the mechanical load applied onto the GIC is relatively low compared to the load applied in cases in which the GIC is embedded within solid matter, such as when the GIC is placed within the large bowel. At the second mode which is the agitated mode the motor is rotated at a predefined power which is significantly higher than the power in which the motor rotates during the sensing mode.

Similarly the rotations are intermittently accomplished along a predefined rotation time, which is the width in time of a pulse of vibrations and mechanical shocks; the pulses interleaved with pauses are cyclically repeated at a predefined repetition rate along a predefined number of cycles. Such intermittent rotations vigorously agitate the body of the solid matter attached to or enclosing the GIC, thereby the adjacent GI walls are significantly agitated. The load applied onto the motor is continuously measured along the cycles of the vigorous agitation during the operation at the agitated mode as well. In a case in which the measured load decreases below a second predefined threshold the servo mechanism automatically switches the motor back to operate at the sensing mode. Namely when the GIC breaks and crumbles the body of the solid matter the power of the pulse trains is lowered to the moderate level of the sensing mode such that hazards of causing pain or harming the GI wall are significantly decreased. However a chunk of the solid matter enclosing the GIC is agitated to vibrate by the pulses of vigorous vibrations and mechanical shocks induced by the GIC thereby mechanically stimulating the GI wall.

Optionally a third threshold which is a safety threshold that is higher than both above mentioned first and second thresholds is employed. When the load applied onto the motor exceeds the safety threshold the motor is stopped for a predefined safety pause to cool down and be reactivated to continue its operation of the agitated mode.

The initial activation of this GIC is such delayed that the GIC normally reaches the targeted location within the large bowel by being conveyed by the transited chyme prior to its activation. However the GIC might be delayed by any obstacle that might be present along the GI tract, or even stopped for example within the caecum. The agitated GIC while operating at the sensing mode can migrate off such obstacle or niche and continue in its normal transit along the GI tract towards its targeted zone. The moderate agitations during the sensing mode provides for supporting the transit of the GIC and save electric power to the agitated mode that is activated only after the GIC accomplishes a number of sensing cycles to assure its being embedded in a solid matter within the large bowel. The activation of this GIC is somewhat complex as it includes a number of partial activation, an automatic activation after a programmed time delay and two partial activations externally induced by an external mechanical load reaching two distinct predefined thresholds. Optionally a fourth partial activation exists according to the invention similarly based on an automatic measuring time delay, which is externally induced by the mechanical load applied onto the GIC by exceeding the safety load.

In FIG. 2 a fragmented isometric view of a GIC in accordance with another preferred embodiment of the present invention is shown at a contracted position. Similarly to the GIC described above with reference to FIG. 1, the external shell of this GIC consists of two segments slidingly attached to each other. At a contracted position 40, a portion of segment 42 encloses a respective portion of segment 42, such that clearance 46 is formed between both of them. Resilient spikes 48 enclosed within clearance 46 are attached to the external surface of segment 44. In FIG. 3 a sectional view of a segment of GIC 50 is shown. Segment 52 and segment 54 of the shell of GIC 50 encloses resilient spike 56 thereby forcing the spike to be inclined towards segment 54 of the shell. When both segments of the shell are pulled in opposite directions from each other whereby GIC 50 is extended spike 56 is free to straighten up and spread open. Optionally the free ends of the spikes are arcuate such that they can be engaged or attached for example to the mucosa of the stomach. The spikes are made of biodegradable material, such as Polylactide (PLA) or poly (lactic-co-glycolic acid) (PLGA), as known. As such the spikes provide for anchoring the GIC within a limited region at a pre-specified location along the GI tract by synchronizing its transfer from a contracted position into an expanded one accordingly. Such GICs are set to be contracted prior to their being ingested. Setting is accomplished for example by pressing an inner biasing spring, which forces both shell's segments to be spaced apart, concomitantly with rotating the outermost shell's segment relative to the other segment, whereby the biasing spring is coiled to be contracted. Following the swallowing of the GIC, this spring is continuously coiled back to open and expand the GIC into an extended position concomitantly with releasing its spikes to straighten and spread. Furthermore the extended spring closes an electric circuit to activate the GIC. Such releasing and activating mechanism is employed according to an embodiment of the present invention in which the agitated GIC provide for mechanically stimulating the walls of the stomach. Typically, the winding of the spring to open takes a few minutes which enables the GIC to get into the stomach whilst is being at a contracted position. The vibrations and/or pressure variations applied to segments of the wall of the stomach cause a sensation of satiety or of mild nausea to treat obesity. The spread spikes prevent the GIC from passing through the pylorus. The acidic environment within the stomach provides for degrading the spikes and releasing them off the surface of the GICs shell within a range of a few hours up to one or even two days.

In accordance with another embodiment of the present invention the fabricated GIC has a unified shell onto which similar spikes made of a biodegradable material are attached. The spikes are forced to bend towards the surface of the GIC by means of a thin film of biodegradable material. The rate in which this film degrades within the stomach is significantly higher than the degradation rate of the spikes. The width of the film and its composition is such selected that within a few dozen of minutes it degrades and releases the spikes to straighten up and spread.

A GIC in accordance with an embodiment of the present invention provides for treating gastro-paresis. In accordance with another embodiment of the present invention a GIC provides for treating chronic pseudo-obstruction and/or other atonic or hypotonic problems of the small bowel. Furthermore a GIC of the invention provides for regaining or improving the gastrointestinal motility after abdominal surgery of after acute infections or inflammations of the GI tract or of the peritoneum that may cause acute paralysis of the motor activity of the GI tract.

As a GIC of the invention is naturally evacuated off the GI tract with the stool, the shell or segments of the shell of a GIC are made of a hard biocompatible material which is not biodegradable. Typically thermoplastic materials such as polyurethane or metals such as stainless steel are utilized for their manufacturing.

EXAMPLE

A GIC suitable for treating constipation in accordance with a preferred embodiment of the present invention encapsulated has a unified shell elliptically shaped having a diameter of 8 mm and length of 15 mm. The weight of the GIC is 10 grams. The agitation means of the GIC consists of an unbalanced electric motor energized by a miniature lithium-cadmium battery having a power density of 5 watts/gram. A segment of the shell, which is compressible, covers an operating switch. This switch provides for setting on the embedded activation mechanism, which is programmed to delay the activation of the GIC by 6 hours following the pressing of the switch. The activated GIC starts moving initially at a sensing mode, such that series of pulses of vibration and shocks of a moderate power are agitated. The widths in time of the pulses at the sensing mode are in the range of 1 to 15 seconds; the pulse repetition rate is in the range of 0.1-10 Hz; the series of pulses are agitated along a time interval in the range of 4 to 10 minutes. The series of pulses are cyclically repeated at the same time profiles following a pause whose length in time is in the range of 3-10 minutes, unless a threshold of the level of the mechanical load induced onto the motor is achieved, whereby the GIC is automatically switched to operate at an agitated mode. The time profile of the pulses agitated at this mode is the same as in the sensing mode except that their level of power is significantly higher, typically three to ten times higher compared to the power of the pulses of the sensing mode. While operating in the agitated mode, the level of forces exerted by the shell of the GIC onto the enclosing solid matter reaches roughly up to 0.2 Newton, which is equivalent to inducing a change in the ambient pressure of 100 cm of water. The series of pulses of the agitated mode interleaved with pauses the lengths of which are the same as those of the sensing mode are repeatedly agitated, unless one of the following events occurs: (a) the GIC is naturally evacuated with the stool; b a threshold of low mechanical loading is crossed, by which the entire process starts all over again namely, the GIC restarts operating at the sensing mode following a pause whose length in time is in the range of 15 min to half an hour; (c) a safety threshold is crossed whereby the process restarts with series of pulses of the agitated mode.

The invention claimed is:

1. A method of treating constipation of a human user, the method comprising:

(a) providing a gastrointestinal capsule adapted to transit an alimentary canal of the human user, said capsule including:

a housing arranged along a longitudinal axis;

a battery, disposed within said housing;

a vibrating agitation mechanism housed within said housing and powered by said battery, said vibrating agitation mechanism adapted, in an operative mode, to vibrate at a frequency of at least one Hz, thereby to apply axial forces along said longitudinal axis;

(b) ingesting said gastrointestinal capsule; and (c) activating said vibrating agitation mechanism such that said operative mode occurs a predetermined time after ingestion of said capsule, when said capsule is disposed within a large intestine of a gastrointestinal tract of the human user, thereby to treat the constipation of the human user.

2. The method of claim 1, said activating including pre-setting an activation time delay of said capsule, prior to said ingesting.

3. The method of claim 1, wherein said axial forces applied along said longitudinal axis effect mechanical stimulation on a wall of the gastrointestinal tract of said human user.

4. The method of claim 1, wherein said housing comprises a segmented hollow shell including first and second members, said first and second members being part of said vibrating agitation mechanism, and wherein, in said operative mode, said first member is moved in an opposite direction with respect to said second member, thereby to cause vibration of said vibrating agitation mechanism.

5. The method of claim 2, said human user being a particular human user, wherein said pre-setting of said activation time delay is according to a transit time of chyme along a gastrointestinal tract of said particular human user.

6. The method of claim 2, said activation time delay being longer than two hours.

7. The method of claim 1, wherein said housing of said gastrointestinal capsule has a length, along said longitudinal axis, of at most 20 mm.

8. The method of claim 1, wherein a weight of said gastrointestinal capsule is no more than 25 grams.

9. The method of claim 1, wherein a weight of said gastrointestinal capsule is no more than 10 grams.

10. A method of treating constipation of a human user, the method comprising:

(a) providing a gastrointestinal capsule adapted to transit an alimentary canal of the human user, said capsule including:

a housing arranged along a longitudinal axis, said housing comprising first and second members;

a battery, disposed within said housing;

a solenoid adapted to drive relative motion of said first and second members of said housing, to effect a vibrating movement of said housing by causing motion of said first member relative to said second member, to cause vibration of said gastrointestinal capsule at a frequency of at least one Hz, thereby to apply axial forces along said longitudinal axis;

(b) ingesting said gastrointestinal capsule; and (c) activating said solenoid such that said vibrating movement of said housing by said motion of said first member relative to said second member occurs a predetermined time after ingestion of said capsule, when said capsule is disposed within a targeted zone within a gastrointestinal tract of the human user, thereby to treat the constipation of the human user.

* * * * *